US012515899B2

(12) United States Patent
Hoang

(10) Patent No.: US 12,515,899 B2
(45) Date of Patent: Jan. 6, 2026

(54) SHEET CONVEYING DEVICE

(71) Applicant: KYOCERA Document Solutions Inc., Osaka (JP)

(72) Inventor: Canh Duc Hoang, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 1 day.

(21) Appl. No.: 18/675,756

(22) Filed: May 28, 2024

(65) Prior Publication Data

US 2024/0400323 A1 Dec. 5, 2024

(30) Foreign Application Priority Data

May 30, 2023 (JP) ..... 2023-089077

(51) Int. Cl.
*B65H 1/04* (2006.01)

(52) U.S. Cl.
CPC ..... *B65H 1/04* (2013.01); *B65H 2405/32* (2013.01)

(58) Field of Classification Search
CPC ..... B65H 2405/323; B65H 2405/324
See application file for complete search history.

(56) References Cited

U.S. PATENT DOCUMENTS

| | | | | |
|---|---|---|---|---|
| 6,196,539 | B1 * | 3/2001 | Lee | B65H 1/02 271/171 |
| 7,869,104 | B2 * | 1/2011 | Murakami | B65H 1/04 271/274 |
| 9,254,972 | B2 * | 2/2016 | Ukai | B65H 1/04 |
| 9,323,203 | B2 * | 4/2016 | Kawashima | G03G 15/605 |
| 9,387,702 | B2 * | 7/2016 | Poma | B65H 1/04 |
| 10,189,666 | B2 * | 1/2019 | Mori | H04N 1/0053 |
| 10,477,047 | B2 * | 11/2019 | Uchida | B65H 1/04 |

FOREIGN PATENT DOCUMENTS

| | | | |
|---|---|---|---|
| JP | 2004323172 | A | 11/2004 |
| JP | 3626416 | B2 * | 3/2005 |
| JP | 3652876 | B2 * | 5/2005 |

OTHER PUBLICATIONS

Translation of JP 3626416 B2 (Year: 2025).*
Translation of JP-3652876-B2 (Year: 2025).*

* cited by examiner

*Primary Examiner* — Howard J Sanders
(74) *Attorney, Agent, or Firm* — Alleman Hall & Tuttle LLP

(57) ABSTRACT

A sheet conveying device is provided with an auxiliary tray provided so as to be able to come in and out of a main tray for feeding a sheet or discharging a sheet provided on a side surface of an image forming apparatus main body so that a sheet can be placed thereon, a blade provided so as to be able to come in and out of the auxiliary tray, and a spring portion configured to urge the blade in a direction in which the blade is expanded from the auxiliary tray. When the auxiliary tray is expanded, the blade is expanded in a width direction of the auxiliary tray by the spring portion.

2 Claims, 4 Drawing Sheets

SHEET CONVEYING DEVICE

INCORPORATION BY REFERENCE

This application is based upon and claims the benefit of priority from the corresponding Japanese Patent Application No. 2023-089077 filed on May 30, 2023, the entire contents of which are incorporated herein by reference.

BACKGROUND

The present disclosure relates to a sheet conveying device.

Conventionally, a tray for feeding sheets or discharging sheets is known which is used in an image forming apparatus such as a printer, a scanner, a copier, a facsimile machine, and a multifunction peripheral when sheets are fed or discharged from a side surface of the image forming apparatus.

The tray is provided so as to be able to come in and out of a side surface of the main body of the image forming apparatus. For example, some trays include a main tray and an auxiliary tray that is stored in the main tray when the main tray is stored and is expanded from the main tray when the main tray is expanded.

However, in general, when a tray consists of a main tray and an auxiliary tray, the width of the auxiliary tray is narrower than the width of the main tray. Accordingly, with large-sized sheets, there has been a problem that the sheets may fall from both sides of the auxiliary tray or the edges of the sheets may hang down.

SUMMARY

A sheet conveying device according to the present invention is provided with an auxiliary tray provided so as to be able to come in and out of a main tray for feeding a sheet or discharging a sheet provided on a side surface of an image forming apparatus main body so that a sheet can be placed thereon, a blade provided so as to be able to come in and out of the auxiliary tray, and a spring portion configured to urge the blade in a direction in which the blade is expanded from the auxiliary tray. When the auxiliary tray is expanded, the blade is expanded in a width direction of the auxiliary tray by the spring portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
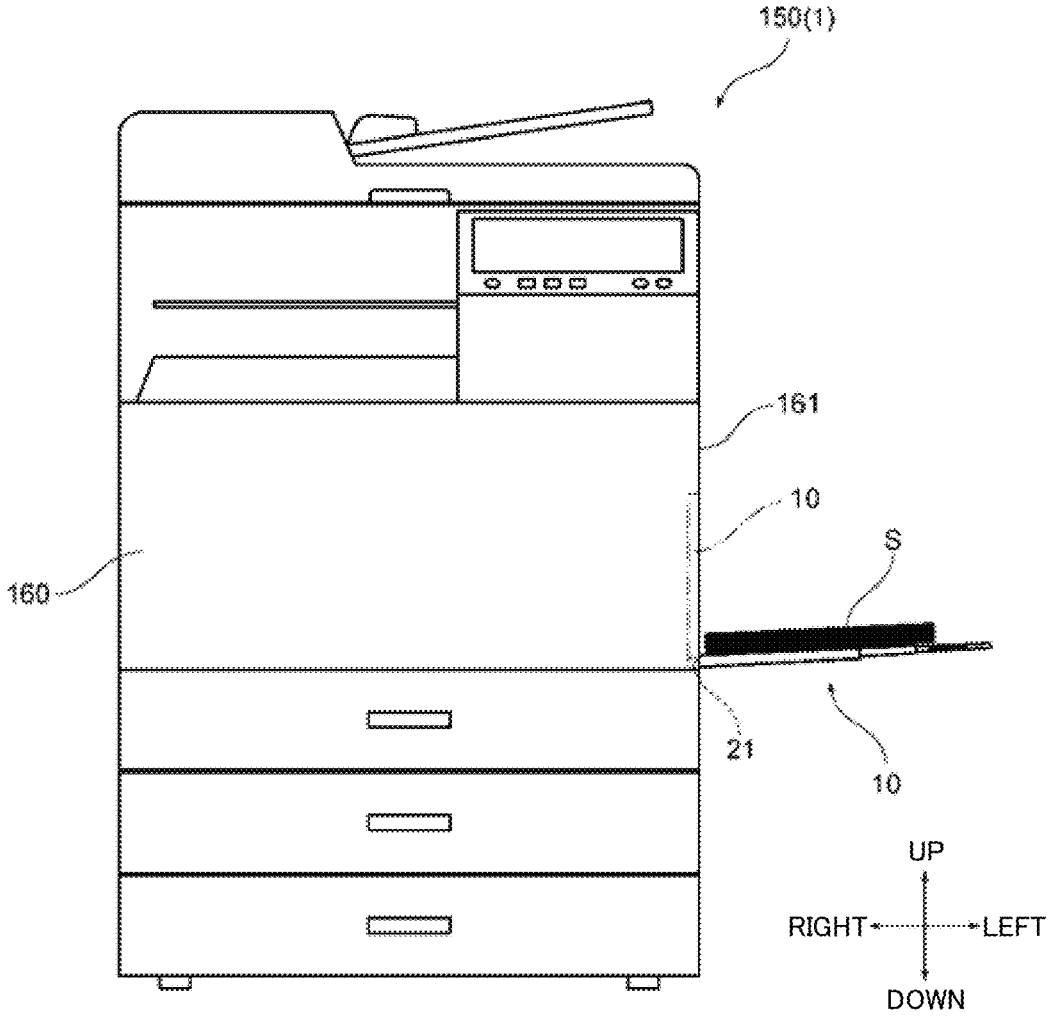
FIG. 1 is a front view showing an example of an image forming apparatus in which a sheet conveying device according to an embodiment of the present invention is installed.

Hereinafter, an embodiment of the present invention will be described with reference to the drawings. It is noted that, in the drawings, the same or corresponding portions are denoted by the same reference numeral, and descriptions thereof will not be repeated.

First, a sheet conveying device 1 and an image forming apparatus 150 will be described with reference to FIG. 1. FIG. 1 is a front view showing an example of the image forming apparatus 150 in which the sheet conveying device 1 according to the present embodiment is installed.

In the following description, the up-down direction when the image forming apparatus 150 is installed in a state of general use as shown in FIG. 1 is defined as the up-down direction, and the front-rear direction is defined with the side on which the user generally stands as the front side. The direction orthogonal to the up-down direction and the front-rear direction is defined as the left-right direction.

The sheet conveying device 1 is applied to the image forming apparatus 150. The image forming apparatus 150 is, for example, a printer, a scanner, a copier, a facsimile machine, or a multifunction peripheral.

The image forming apparatus 150 includes a device that conveys a sheet S serving as a document sheet to be copied or read, or a sheet S on which an image has been formed. This device that conveys the sheet S is the sheet conveying device 1.

Figure 2:
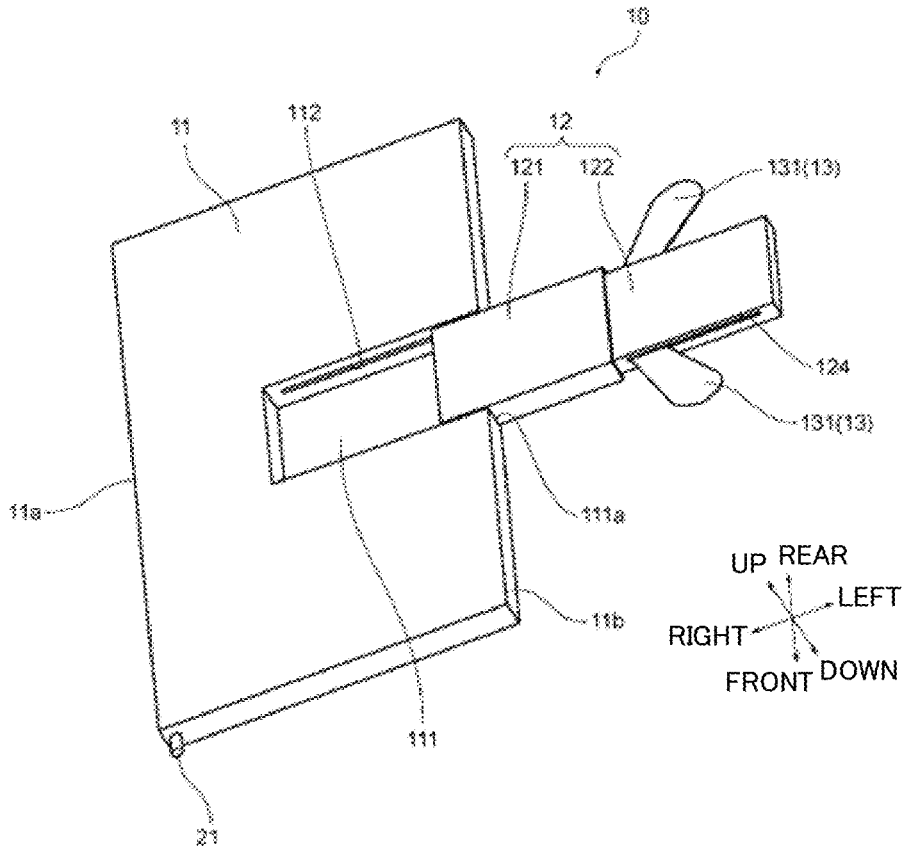
FIG. 2 is a perspective view showing a tray of the sheet conveying device according to an embodiment of the present invention.
Figure 3:
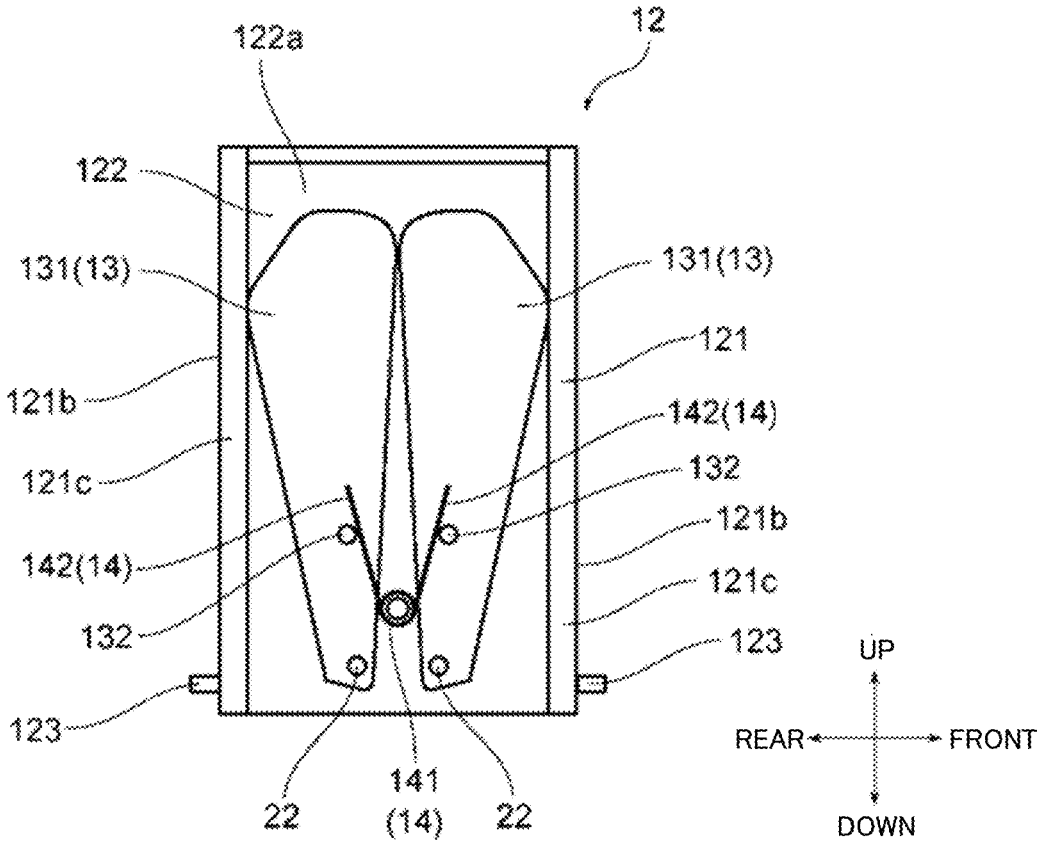
FIG. 3 is a bottom view of an auxiliary tray of the sheet conveying device shown in FIG. 2.
Figure 4:
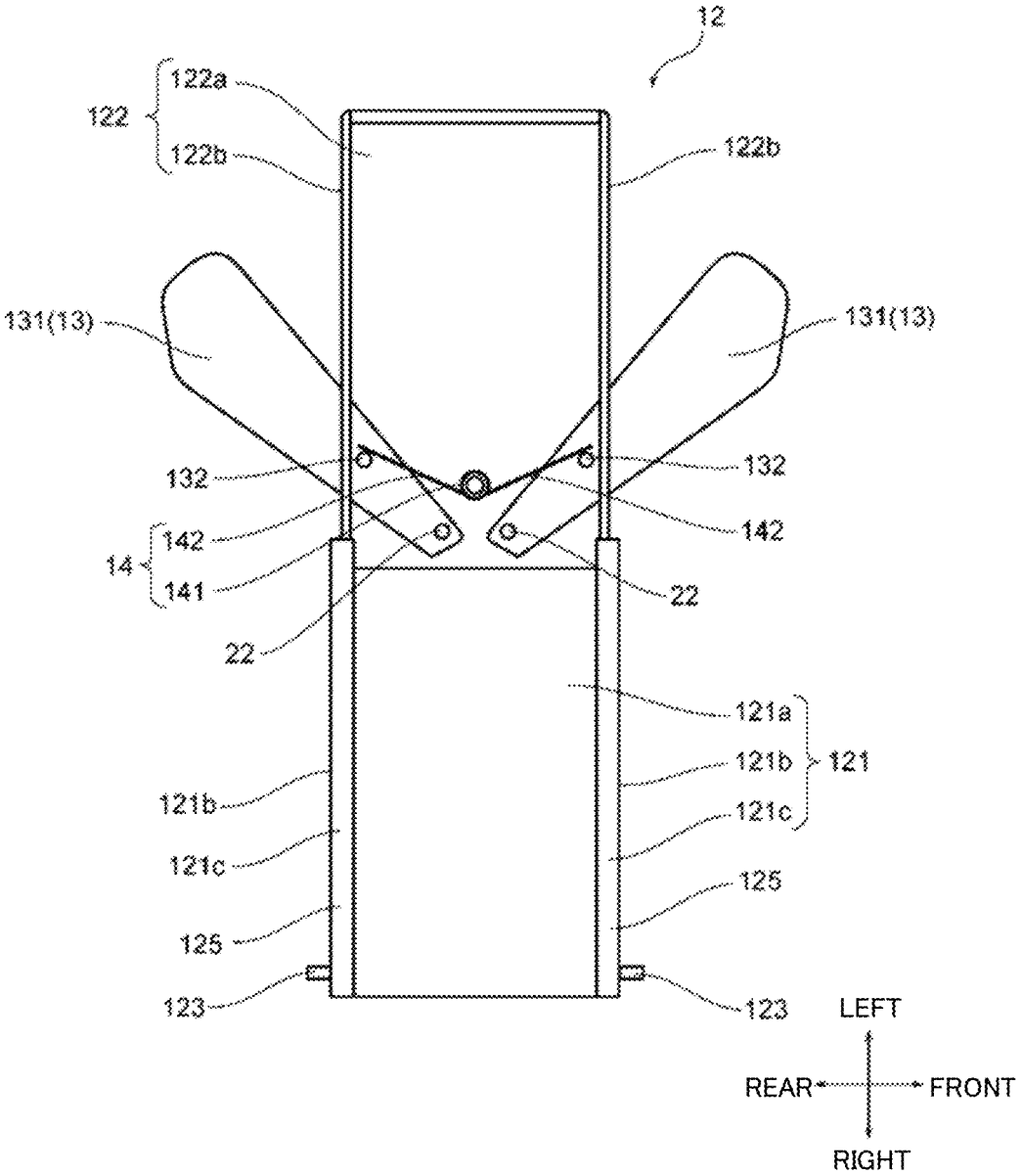
FIG. 4 is a bottom view of the auxiliary tray of the sheet conveying device shown in FIG. 2.

Next, the sheet conveying device 1 of the present embodiment will be described with additional reference to FIG. 2 to FIG. 4. FIG. 2 is a perspective view showing a tray 10 of the sheet conveying device 1 according to the present embodiment. FIG. 3 and FIG. 4 are bottom views of an auxiliary tray 12 of the sheet conveying device 1 of the present embodiment.

FIG. 3 shows a state in which a second auxiliary tray 122 is stored in a first auxiliary tray 121, and FIG. 4 shows a state in which the second auxiliary tray 122 is expanded from the first auxiliary tray 121.

As shown in FIG. 1, the sheet conveying device 1 includes the tray 10 for feeding sheets or discharging sheets, which is provided on a side surface 161 of an image forming apparatus main body 160 so that a sheet S can be placed thereon. The tray 10 is provided so as to be able to come in and out of the image forming apparatus main body 160. In FIG. 1, a state in which the tray 10 is expanded is indicated by a solid line, and a state in which the tray 10 is stored is indicated by a dash-dot-dot-dash line.

In the following description, it is assumed that the tray 10 is expanded from the image forming apparatus main body 160, and as shown in FIG. 2, the up-down direction is defined with the surface of the tray 10 on which the sheet S (see FIG. 1) is placed as the upper surface.

Since the tray 10 is installed on the left side surface of the image forming apparatus 150 as shown in FIG. 1, the left-right direction is defined with the side of the tray 10 attached to the image forming apparatus main body 160 as the right side as shown in FIG. 2. The direction orthogonal to the up-down direction and the left-right direction is defined as the front-rear direction.

As shown in FIG. 2, the tray 10 includes a main tray 11, an auxiliary tray 12, and a blade 13.

The main tray 11 is a tray for feeding sheets or discharging sheets, on which a sheet S to be supplied to the image forming apparatus 150 or a sheet S to be discharged from the image forming apparatus 150 is placed. As shown in FIG. 1, the main tray 11 is provided so as to be able to come in and out of the side surface 161 of the image forming apparatus main body 160.

As shown in FIG. 2, the main tray 11 has a substantially rectangular plate shape having a size that can be stored in the side surface 161 of the image forming apparatus main body 160. The main tray 11 has a shaft 21 extending in the front-rear direction in the front and rear side surfaces of its right end portion 11*a*.

The main tray 11 is rotatably attached to the side surface 161 of the image forming apparatus main body 160 by the shaft 21. The main tray 11 rotates around the shaft 21 to move between a state in which the main tray 11 is expanded from the image forming apparatus main body 160 and a state in which the main tray 11 is stored in the image forming apparatus main body 160. It is noted that the shaft 21 may be provided in the image forming apparatus main body 160, and a bearing for receiving the shaft 21 may be formed in the main tray 11.

A storage portion 111 that stores the auxiliary tray 12 is formed in the main tray 11. The storage portion 111 is formed by cutting out a part of the main tray 11.

The storage portion 111 has a size that can store the auxiliary tray 12. The storage portion 111 has its left end surface located at a left end surface 11*b* of the main tray 11 and has an opening 111*a* on the entire left end face of the storage portion 111. In addition, a pair of grooves 112 for allowing the auxiliary tray 12 to come in and out are formed in the front side surface and the rear side surface of the storage portion 111.

The auxiliary tray 12 is provided so as to be able to come in and out of the main tray for feeding sheets or discharging sheets, which is provided on a side surface of the image forming apparatus main body 160 so that the sheet S can be placed thereon. That is, the auxiliary tray 12 is provided so as to be able to expand from the main tray for feeding sheets or discharging sheets, which is provided on a side surface of the image forming apparatus main body 160 so that the sheet S can be placed thereon.

The auxiliary tray 12 is provided so that it can be stored in the main tray for feeding sheets or discharging sheets, which is provided on a side surface of the image forming apparatus main body 160 so that the sheet S can be placed thereon.

That is, the auxiliary tray 12, together with the main tray 11, is a tray on which a sheets S to be supplied to the image forming apparatus 150 or a sheet S discharged from the image forming apparatus 150 is placed. The auxiliary tray 12 is provided so as to be able to move in and out of the main tray 11.

As shown in FIG. 2 to FIG. 4, in the present embodiment, the auxiliary tray 12 is composed of a first auxiliary tray 121 and a second auxiliary tray 122. The first auxiliary tray 121 is provided so as to be able to come in and out of the main tray 11, and the second auxiliary tray 122 is provided so as to be able to come in and out of the first auxiliary tray 121.

That is, the first auxiliary tray 121 is provided so that it can be expanded from the main tray 11. The first auxiliary tray 121 is provided so that it can be stored in the main tray 11. The second auxiliary tray 122 is provided so that it can be expanded from the first auxiliary tray 121. The second auxiliary tray 122 is provided so that it can be stored in the first auxiliary tray 121.

Specifically, the first auxiliary tray 121 is composed of a substantially rectangular-shaped upper plate 121*a*, a pair of side plates 121*b* extending downward from the front side and the rear side of the upper plate 121*a*, and a pair of lower plates 121*c* extending from the side plates 121*b* in parallel with the upper plate 121*a*.

The side plates 121*b* and the lower plates 121*c* have a length in the left-right direction substantially equal to the length in the left-right direction of the upper plate 121*a*. The width (length in the front-rear direction) of the lower plates 121*c* has a length that allows the pair of lower plates 121*c* to hold the second auxiliary tray 122. The first auxiliary tray 121 composed of the upper plate 121*a*, the side plates 121*b*, and the lower plates 121*c* has a size that can be stored in the storage portion 111.

A projection 123 extending in the front-rear direction is provided at the right end portion of each of the side plates 121*b* of the first auxiliary tray 121. The projections 123 can be inserted into the grooves 112 formed in the storage portion 111, and have a size that can move along the grooves 112.

When the projections 123 move in the grooves 112 in the left-right direction, the first auxiliary tray 121 comes in and out of the main tray 11 through the opening 111*a* at the left end surface of the storage portion 111.

The second auxiliary tray 122 is composed of a substantially rectangular-shaped upper plate 122*a* and a pair of side plates 122*b* extending downward from the front side and the rear side of the upper plate 122*a*. The side plates 122*b* have a length in the left-right direction substantially equal to the length in the left-right direction of the upper plate 122*a*.

The width (length in the up-down direction) of the side plates 122*b* has a length that allows the side plates 122*b* to fit between the upper plate 121*a* and the lower plates 121*c* of the first auxiliary tray 121. The second auxiliary tray 122, which is composed of the upper plate 122*a*, the side plates 122*b*, and the lower plates 122*c*, has a size that can be inserted between the upper plate 121*a* and the lower plates 121*c* of the first auxiliary tray 121 and stored in the first auxiliary tray 121.

A blade port 124 extending in the left-right direction is formed in each of the side plates 122*b* of the second auxiliary tray 122. The blade port 124 has a size that allows the blade 13 to come in and out.

The second auxiliary tray 122 comes in and out of the first auxiliary tray 121 by moving in the left-right direction between a pair of rails 125 formed by the upper plate 121*a* and the pair of lower plates 121*c* of the first auxiliary tray 121.

The blade 13, together with the main tray 11 and the auxiliary tray 12, is a member for placing a sheet S to be supplied to the image forming apparatus 150 or a sheet S discharged from the image forming apparatus 150. The blade 13 is provided so as to be able to come in and out of the auxiliary tray 12.

In the present embodiment, the blade 13 is composed of a pair of blade members 131. In plan view (FIG. 3 view), each blade member 131 has a narrower width (length in the front-rear direction) on the side closer to the image forming apparatus main body 160 (right side) and a wider width (length in the front-rear direction) on the side away from the image forming apparatus main body 160 (left side).

In addition, the blade member 131 has a thickness that can pass through the blade port 124 formed in the side plate 122*b* of the second auxiliary tray 122. The blade members 131 have a size that fits on the upper plate 122*a* of the second auxiliary tray 122 when the pair of blade members 131 are arranged side by side.

A spring portion 14 urges the blade 13 in a direction of expanding from the auxiliary tray 12. In the present embodiment, the spring portion 14 is constituted by a torsion spring 14.

That is, the spring portion 14 is constituted by a torsion spring 14 composed of a center portion 141 wound in a circular shape and a pair of end portions 142 protruding outward from the center portion 141 to extend in a rod shape.

When the auxiliary tray 12 is expanded, the blade 13 is expanded in the width direction of the auxiliary tray 12 by the spring portion 14.

That is, the pair of blade members 131 are each rotatably attached by a shaft 22 to the lower surface of the upper plate 122*a* of the second auxiliary tray 122 at its right end portion having a narrow width. At this time, the blade member 131 is attached to a position where it can pass through the blade port 124 formed in the side plate 122*b* of the second auxiliary tray 122.

The blade 13 (the pair of blade members 131) is engaged with both of the end portions 142 of the spring portion 14 (torsion spring 14).

That is, the torsion spring 14 is attached with the center portion 141 fixed to the lower surface of the upper plate 122*a* of the second auxiliary tray 122. At this time, the end portions 142 of the torsion spring 14 extend from the center portion 141 to the left front and the left rear, respectively. A spring engagement projection 132 extending downward is provided on the lower surface of each blade member 131.

Each of the end portions 142 of the torsion spring 14 is engaged with the spring engagement projection 132 of the corresponding blade member 131.

When the second auxiliary tray 122 is expanded, the blade 13 (the pair of blade members 131) is expanded in the width direction of the second auxiliary tray 122 by the spring portion 14 (torsion spring 14).

When the end portions 142 of the torsion spring 14 are widened, each blade member 131 pushes the spring engagement projection 132, thereby rotating around the shaft 22 to project from the blade port 124.

The blade member 131 then expands in the width direction (front-rear direction) of the second auxiliary tray 122. It is preferable that each blade member 131 and the torsion spring 14 are configured such that the angle formed by the sides of the pair of blade members 131 facing each other at this time is 90 degrees.

Next, an operation of the tray 10 of the sheet conveying device 1 will be described.

When the tray 10 is used for placing a sheet S on the tray 10, the main tray 11 is opened from the image forming apparatus main body 160 by using a holding portion (not shown) provided on the main tray 11.

The main tray 11 is expanded by being rotated around the shaft 21. At this time, the first auxiliary tray 121 and the second auxiliary tray 122 are stored in the storage portion 111 of the main tray 11.

When the size of the sheet S is not so large and only the first auxiliary tray 121 is used, the first auxiliary tray 121 and the second auxiliary tray 122 are held together at their left end portions, and pulled out together. At this time, the second auxiliary tray 122 remains stored in the first auxiliary tray 121. As a result, the first auxiliary tray 121 is expanded from the main tray 11 as the projections 123 move along the grooves 112.

When the size of the sheet S is large and the second auxiliary tray 122 is also used, the second auxiliary tray 122 is held at the left end portion and pulled out. Thus, the second auxiliary tray 122 moves along the rails 125 and is expanded from the first auxiliary tray 121.

The first auxiliary tray 121 and the second auxiliary tray 122 may be pulled out sequentially, or the first auxiliary tray 121 and the second auxiliary tray 122 may be pulled out from the main tray 11 at a time by holding only the left end portion of the second auxiliary tray 122.

In a state in which the blade members 131 are stored in the second auxiliary tray 122, the end portions 142 of the torsion spring 14 are compressed and have an urging force in a direction of opening each other (front-rear direction).

When the second auxiliary tray 122 is expanded, the spring engagement projections 132 engaged with the end portions 142 of the torsion spring 14 are pushed outward in the front-rear direction by the urging force of the end portions 142 of the torsion spring 14. Each blade member 131 rotates around the shaft 22 and projects from the blade port 124. Thus, the blade members 131 are expanded in the width direction (front-rear direction) of the second auxiliary tray 122 by the torsion spring 14.

When the tray 10 is stored, the left end portion of the second auxiliary tray 122 is pushed back toward the main tray 11. When the second auxiliary tray 122 is stored in the first auxiliary tray 121, the second auxiliary tray 122 moves along the rails 125 and is stored in the first auxiliary tray 121. At this time, the blade members 131 hit the side plates 121*b* of the first auxiliary tray 121, and are pushed by the side plates 121*b* of the first auxiliary tray 121 and rotated around the shafts 22 to be pushed into the second auxiliary tray 122 through the blade ports 124. Thus, the blade members 131 are automatically stored in the second auxiliary tray 122.

In a state in which the second auxiliary tray 122 is stored in the first auxiliary tray 121, the left end portions of the second auxiliary tray 122 and the first auxiliary tray 121 are pushed back toward the main tray 11 together. Thus, the projections 123 of the first auxiliary tray 121 moves along the grooves 112, and the first auxiliary tray 121 and the second auxiliary tray 122 are stored in the storage portion 111 of the main tray 11. In this state, by rotating the main tray 11 around the shaft 21, the main tray 11 is stored in the image forming apparatus main body 160.

As described above, in the sheet conveying device 1 of the present embodiment, the blade members 131 are expanded in the width direction of the second auxiliary tray 122 by the torsion spring 14.

Thus, the width of the second auxiliary tray 122 can be increased by the blade members 131. As a result, even if the size of the sheet S is large, the sheet S can be prevented from falling down or hanging down.

In addition, the blade members 131 can be expanded or stored by a simple operation of pulling out or pushing back the second auxiliary tray 122. With such a simple operation, the width of the second auxiliary tray 122 can be increased, improving user convenience.

An embodiment of the present invention has been described above with reference to the drawings. However, the present invention is not limited to the above-described embodiment, and can be implemented in various modes without departing from the gist thereof.

In addition, various inventions can be formed by appropriately combining a plurality of constituent elements disclosed in the above-described embodiment. For example, some constituent elements may be deleted from all the constituent elements shown in the embodiment. In the drawings, the constituent elements are mainly shown schematically for the sake of easy understanding.

The number or the like of each constituent element shown in the drawings may be different from the actual number or the like from the convenience of preparation of drawings. In addition, the constituent elements shown in the above embodiment are merely examples and are not particularly limited, and various changes can be made within a range that does not substantially depart from the effects of the present invention.

In the above-described embodiment, the main tray 11, the first auxiliary tray 121, and the second auxiliary tray 122 are shown as trays having a certain thickness. However, this is to facilitate the understanding of the present invention, and the present invention is not limited thereto.

The main tray 11, the first auxiliary tray 121, and the second auxiliary tray 122 can adopt any known tray shape as long as the first auxiliary tray 121 is configured to be able to come in and out of the main tray 11 and the second auxiliary tray 122 is configured to be able to come in and out of the first auxiliary tray 121.

Further, in the above-described embodiment, the first auxiliary tray 121 can be moved in and out of the main tray 11 by the engagement between the grooves 112 and the projections 123, and the second auxiliary tray 122 can be moved in and out of the first auxiliary tray 121 by the rails 125, but the present invention is not limited thereto.

For example, the first auxiliary tray 121 may be configured to be able to come in and out along a rail provided on the main tray 11. Similarly, the second auxiliary tray 122 may be configured to be able to come in and out along a groove provided in the first auxiliary tray 121. Any known configuration can be adopted as long as the first auxiliary tray 121 can move in the left-right direction with respect to the main tray 11 and the second auxiliary tray 122 can move in the left-right direction with respect to the first auxiliary tray 121.

In addition, in the above-described embodiment, the blade 13 is composed of a pair of blade members 131, but the present invention is not limited thereto.

For example, the blade 13 may be composed of one blade member or three or more blade members.

In addition, in the above-described embodiment, the spring portion 14 is constituted by the torsion spring 14, but the present invention is not limited thereto.

For example, the spring portion 14 may be constituted by a compression coil spring. Any known spring can be used for the spring portion 14 as long as the spring portion 14 can urge the blade 13 in a direction of expanding from the second auxiliary tray 122 when the second auxiliary tray 122 is pulled out.

In addition, in the above-described embodiment, the auxiliary tray 12 is composed of the first auxiliary tray 121 and the second auxiliary tray 122, but the present invention is not limited thereto.

The auxiliary tray 12 may be a single tray in which the first auxiliary tray 121 and the second auxiliary tray 122 are integrated. In this case, the blade 13 is provided in the auxiliary tray 12 in the same manner as in the second auxiliary tray 122 in the above-described embodiment.

In addition, similarly to the first auxiliary tray 121 of the above-described embodiment, the auxiliary tray 12 is provided so as to be able to come in and out of the main tray 11. When the auxiliary tray 12 is pulled out from the main tray 11 or stored in the main tray 11, the blade 13 is expanded from or stored in the auxiliary tray 12.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a main tray for feeding a sheet or discharging a sheet provided on a side surface of an image forming apparatus main body so that a sheet can be placed thereon;

a first auxiliary tray stored in the main tray and capable of being pulled out from the main tray in a first direction away from the image forming apparatus main body;

a second auxiliary tray stored in the first auxiliary tray and capable of being pulled out from the first auxiliary tray in the first direction;

a pair of blade members stored in the second auxiliary tray and capable of rotating about a pair of shafts within the second auxiliary tray to expand to respective sides of the second auxiliary tray in a second direction orthogonal to the first direction; and a spring portion configured to urge the pair of blade members in a direction in which the pair of blade members are expanded from the second auxiliary tray, wherein the first auxiliary tray includes a pair of side plates formed on respective ends in the second direction of the first auxiliary tray, the pair of blade members are stored in the second auxiliary tray while in contact with the pair of side plates, and when the second auxiliary tray is pulled out from the first auxiliary tray in the first direction, the pair of blade members expand beyond a width of the first auxiliary tray in the second direction due to an urging force of the spring portion.

2. The sheet conveying device according to claim 1, wherein the spring portion includes a torsion spring, and the pair of blade members are engaged with both end portions of the torsion spring.

* * * * *